US012398510B2

(12) United States Patent
Rößler et al.

(10) Patent No.: US 12,398,510 B2
(45) Date of Patent: Aug. 26, 2025

(54) LAYER COMPOSITE FOR USE AS IMITATION LEATHER

(71) Applicant: NUVI RELEAF GmbH, Frankfurt am Main (DE)

(72) Inventors: Andreas Rößler, Fernwald (DE); Nina Rößler, Fernwald (DE)

(73) Assignee: NUVI RELEAF GmbH, Frankfurt am Main (DE)

( * ) Notice: Subject to any disclaimer, the term of this patent is extended or adjusted under 35 U.S.C. 154(b) by 1164 days.

(21) Appl. No.: 17/286,594

(22) PCT Filed: Oct. 18, 2019

(86) PCT No.: PCT/EP2019/078455
§ 371 (c)(1),
(2) Date: Apr. 19, 2021

(87) PCT Pub. No.: WO2020/079269
PCT Pub. Date: Apr. 23, 2020

(65) Prior Publication Data

US 2021/0332527 A1 Oct. 28, 2021

(30) Foreign Application Priority Data

Oct. 20, 2018 (DE) ..... 10 2018 008 307.2

(51) Int. Cl.
*D06N 3/00* (2006.01)

(52) U.S. Cl.
CPC ..... *D06N 3/0061* (2013.01); *D06N 3/0006* (2013.01); *D06N 3/0011* (2013.01); *D06N 3/0086* (2013.01); *D06N 2211/10* (2013.01); *D06N 2211/28* (2013.01)

(58) Field of Classification Search
None
See application file for complete search history.

(56) References Cited

U.S. PATENT DOCUMENTS

| | | | |
|---|---|---|---|
| 6,838,043 | B1 | 1/2005 | Wagner et al. |
| 2007/0184742 | A1 | 8/2007 | Coulson et al. |

FOREIGN PATENT DOCUMENTS

| | | | |
|---|---|---|---|
| CN | 101563467 | A | 10/2009 |
| CN | 203198318 | U | 9/2013 |
| DE | 1 635 546 | A1 | 3/1971 |
| DE | 199 37 808 | A1 | 6/2001 |
| DE | 102006001095 | A1 | 7/2007 |
| DE | 10 2015 101 331 | A1 | 8/2016 |
| GB | 2010750 | A | 7/1979 |
| GB | 2569097 | A | 6/2019 |
| JP | 58-173517 | A | 10/1983 |
| JP | 3210849 | U | 6/2017 |
| RU | 2193972 | C2 | 12/2002 |
| RU | 2233359 | C2 | 7/2004 |
| WO | WO-98/03333 | A2 | 1/1998 |
| WO | 2007/091770 | A1 | 8/2007 |

OTHER PUBLICATIONS

Russian Office Action dated Feb. 24, 2022 issued in Russian Application No. RU 2021114092/04.
Russian Search Report dated Feb. 24, 2022 issued in Russian Application No. RU 2021114092/04.

*Primary Examiner* — Arti Singh-Pandey
(74) *Attorney, Agent, or Firm* — MEDLER FERRO WOODHOUSE & MILLS PLLC

(57) ABSTRACT

The invention relates to a layer composite for use as imitation leather, to a method for producing the layer composite and to the use of the thereof.

20 Claims, 3 Drawing Sheets

LAYER COMPOSITE FOR USE AS IMITATION LEATHER

CROSS REFERENCE TO RELATED APPLICATIONS

This application is a National Stage of International Application No. PCT/EP2019/078455 filed Oct. 18, 2019, which claims benefit of German Patent Application No. 10 2018 008 307.2 filed Oct. 20, 2018, both of which are herein incorporated by reference in their entirety.

SUBJECT-MATTER OF THE INVENTION

The invention relates to a layer composite for use as imitation leather, a method for producing the layer composite, as well as uses of the layer composite.

BACKGROUND OF THE INVENTION

The leather industry is one of the branches with a high potential for environmental pollution. The chemicals used during tanning, in particular antibiotics, tanning agents, biocides and volatile organic chemicals such as formaldehyde, can do long-term damage to the environment if not used properly. However, a correspondingly proper use of the chemicals requires a large outlay in terms of money and time. In addition, the substances used can sometimes remain in the material and only come out during later use. This is associated with health risks for the end consumer. Moreover, there are also ethical concerns relating to the use of animal hides.

Efforts have therefore been made for a long time to replace leather with synthetically produced materials. These surrogates are generally called artificial leather. As a rule, this is a composite of a textile base carrier and a plastic layer, such as for example polyvinyl chloride (PVC) or polyurethane (PU), applied thereto.

DE 1 635 546 A describes an artificial leather which is produced by means of paper production methods, wherein the artificial leather substantially consists of non-fibrous elastomeric polyurethane with relatively small additions of staple fibres, preferably synthetic fibres or leather fibres.

DE 199 37 808 A1 relates to a leather-substitute material, which has a substantially cloth-like carrier layer, a thinner barrier layer applied thereto and a cover layer provided on the barrier layer.

DE 10 2015 101 331 A1 relates to a translucent artificial leather with a textile carrier structure and with at least one layer made of PU or PVC. The layer composite can furthermore have a surface lacquering.

The artificial leathers obtained through these methods have several advantages over animal leather. PVC artificial leathers are favourable in terms of price and robust, while PU artificial leathers have advantageous material properties such as repeated washability. As artificial leather is obtained as a continuous material, it is also much easier to cut to size than animal leather. The production process is also considerably shorter since the laborious tanning process is dispensed with. In addition, artificial leather producers are not bound to the market availability of particular animal hides.

However, previously known artificial leather materials are based substantially on synthetic plastics which are produced from finite fossil resources such as petroleum and are not biodegradable. In addition, as a rule such artificial leather materials still have solvent or dispersant residues and plasticizers and are therefore not completely harmless to health.

Moreover, with artificial leathers it is often not possible to achieve the same visual and haptic properties as with animal leather.

OBJECT

Against this background, the object of the invention was therefore to provide an artificial leather which has visual and haptic properties comparable to, or better than, those of synthetic leather, can be produced in a more environmentally friendly and sustainable way than natural and/or synthetic leather and is at least partly biodegradable.

DESCRIPTION OF THE INVENTION

This object is achieved according to the invention by a layer composite for use as imitation leather, which has the following layers:

a) a carrier layer, which contains textile material,
b) a decorative layer,
c) a cover layer, which contains a plastic, wax or protein material or a mixture of the above-named, wherein the decorative layer is arranged between the textile carrier layer and the cover layer and wherein the decorative layer contains or consists of plant leaf material, preferably tobacco.

By "plant leaf material" is meant according to the invention whole or shredded untreated or treated leaves, in particular leaf powder. By "treated leaves" is meant those plant leaves or shredded sections thereof which have been preserved by fermentation, chemical treatment, in particular with alcohols, or by drying. In a preferred embodiment, the plant leaf material is fermented, i.e. it has been subjected to a fermentation process, which has brought the dried leaves into a storable and usable state.

Alternatively or additionally, the plant leaf material can be chemically treated, this is preferably performed with a mixture of water and a polyvalent alcohol such as glycerol. As a result, the plant leaf material obtains an elastic deformability and an increased ultimate breaking strength, in particular an increased tensile strength and bending tensile strength. In addition, it was established that the plant leaf material can furthermore also undergo a maturing process in the layer composite, which improves the deformability and ultimate breaking strength of the material. The maturing process has a duration of at least a week, preferably two weeks, more preferably a month and most preferably two months. The maturing process results in an improvement in the properties in particular when the cover layer contains or consists of a wax material.

The decorative layer with plant leaf material substantially takes on visual and haptic functions in the layer composite. However, depending on the plant leaf material and the cover layer applied thereto, the decorative layer not only gives the layer composite a good feel and an attractive appearance but also a pleasant smell. This effect can in particular be intensified by partially or completely needle-punching the individual layers of the composite and not gluing and/or pressing them together. As a result, the layer composite has an increased permeability.

In a preferred embodiment of the invention, the decorative layer is substantially free of wood fibres. Within the framework of the present invention this means that the proportion of wood fibres, thus for example material made of wood shavings, sawdust, wood logs and branches is smaller than 5%, preferably smaller than 1%, even more preferably smaller than 0.5% and most preferably smaller than 0.1%.

The plant leaf material is particularly preferably selected from the group consisting of rose leaves, vine leaves, cherry laurel leaves and tobacco. The plant leaf material is particularly preferably tobacco. In a preferred embodiment, the plant leaf material can be reconstituted tobacco.

Tobacco offers several advantages over other plant leaf materials. As a starting material it has very good and year-round availability. Because of falling demand for tobacco, as a rule there is overcapacity in production, which can be purchased at a reasonable price. Furthermore, tobacco has a high proportion of natural alkaloids, in particular nicotine, which act as insecticides. As a result, mites and other pests can be kept away from the layer composite and a particularly durable imitation leather can be obtained. In addition, in particular after treatment with a mixture of water and a polyvalent alcohol, tobacco leaves have a particularly high flexibility and tear strength. The natural smell, in addition to the visual properties, also supports the use of tobacco as decorative layer in an imitation leather. These advantageous properties are particularly pronounced in the case of fermented tobacco.

In addition, tobacco also has moisture-regulating properties and therefore brings about a high degree of wearing comfort of the layer composite when used as imitation leather. This effect is particularly pronounced when the layer composite is partially or completely needle-punched since this results in a high permeability of the material.

In a preferred embodiment, the plant leaf material is dyed with a synthetic or preferably natural dye. The visual properties of different types of animal leather can be imitated hereby. In a particularly preferred embodiment of the invention, the dye is partially or completely food safe and/or consists of substances which, as biological nutrients, can be fed back into biological cycles or, as technical nutrients, can be kept continuously in technical cycles (cradle-to-cradle certification).

The carrier layer brings about the structural strength of the composite and ensures a good processability in particular when the layer composite is stitched.

In a preferred embodiment, the textile carrier layer contains or consists of a material which is selected from the group consisting of nonwoven fabric, woven fabric, knitted fabrics, netting or mixtures of the above-named.

Nonwoven fabric, woven fabric, knitted fabrics, netting or mixtures of the above-named are textile cloths which are constructed of fibres but differ from each other in the arrangement of the fibres.

According to the invention, by nonwoven fabric is meant a fabric made of fibres of limited length, continuous fibres (filaments) or cut yarns of any type and any origin, which have been combined in any way to form a fibre layer and have been joined to each other in any way. This does not include the interlacing or entwining of yarns such as occurs during weaving, warp-knitting, knitting, lace-making, braiding and the production of tufted products. This definition corresponds to Standard DIN EN ISO 9092. According to the invention, the term nonwoven fabric also includes felt cloths. However, nonwoven fabrics do not include films and papers.

The nonwoven fabrics are preferably anisotropic nonwoven fabrics, i.e. those with fibre orientation. As a result, an anisotropic mechanical behaviour of the layer composite can be produced, whereby its tear strength is increased.

According to the invention, by woven fabric is meant a textile fabric which consists of two thread systems, warp (warp threads) and weft (weft threads), which cross each other at an angle of precisely or approximately 90° according to a pattern, viewed onto the surface of the woven fabric. Each of the two systems can be constructed of several types of warp or weft (e.g. ground warp, pile warp and filling warp; ground weft, binding weft and filling weft). The warp threads run in the longitudinal direction of the woven fabric, parallel to the selvedge, and the weft threads run in the transverse direction, parallel to the end of the fabric. The threads are joined to form the woven fabric predominantly by frictional locking. In order that a woven fabric is sufficiently non-slipping, the warp and weft threads must usually be relatively tightly woven. For this reason, apart from a few exceptions, woven fabrics also have a dense appearance. This definition corresponds to Standard DIN 61100, Part 1.

According to the invention, the terms woven fabric and nonwoven fabric also include those textile materials which have been tufted. Tufting is a process in which yarns are anchored in a woven fabric or a nonwoven fabric using a machine driven by compressed air and/or electricity.

According to the invention, by knitted fabrics is meant textile cloths which are produced from thread systems by forming stitches. This includes both crocheted and knitted cloths.

By braiding is meant within the meaning of the invention the regular intertwining of several strands of flexible material. The difference from weaving is that in braiding the threads are not fed at right angles to the main direction of the product.

The fibres of the nonwoven fabrics, woven fabrics, knitted fabrics, netting or mixtures thereof can be natural fibres, man-made fibres or mixtures of the above-named.

The fibres are preferably of plant or animal origin or man-made fibres made of natural polymers or polymers based on natural raw materials. The proportion of natural constituents of the layer composite can hereby be improved, and correspondingly thus the sustainability and biodegradability thereof.

The natural fibres are preferably selected from the group consisting of seed fibres, bast fibres, leaf fibres and animal fibres. They are particularly preferably selected from the group consisting of cotton, animal wool, animal hair, silk, kapok, akon, yumberry, bamboo fibres, common nettle, hemp, hempnettle, jute, urena, flax, ramie, kenaf, roselle, sun hemp, abutilon, pung, ricinus, sisal, abaca, curaua, Fibe, ixtle fibre, arenga, Afrik, henequen, fique, phormium, alfa, maguey, yucca, pita, coir, broom, hop, bulrush and bast.

The man-made fibres are preferably selected from natural polymers or polymers based on natural raw materials. They are particularly preferably selected from the group consisting of viscose, modal, lyocell, cupro, cellulose acetates, protein fibres such as casein fibres, polylactides, alginates, chitin, bio-based polyamides, polyesters and polyisoprenes.

In a further embodiment, the man-made fibres are made of synthetic polymers selected from the group consisting of polyesters such as PET or PBT, polyamide, polyimide, polyamide imide, aramid, poly(meth)acrylates, modacrylic, polytetrafluoroethylene (PTFE), polyethylene, polypropylene, polychloride, PVC, elastane, polystyrene, polycarbonate, polyvinyl alcohol, vinylal, polyphenyl sulfide, melamine, polyurea, polyurethane, polybenzimidazole, polybenzoxazole.

In a preferred embodiment, the thickness of the textile carrier layer is 0.1 to 10 mm, more preferably 0.1 to 5 mm, particularly preferably 0.1 to 2 mm, most preferably 0.2 to 1 mm.

In a preferred embodiment, the mass per unit area (grammage) of the carrier layer is 50 to 200 g/m$^2$, more preferably 65 to 130 g/m$^2$, particularly preferably 80-120 g/m$^2$, most preferably 90-110 $m^2$. Particularly light layer composites can be produced through a low mass per unit area.

In a preferred embodiment, the plant leaf material of the decorative layer is finely ground tobacco and/or tobacco powder and/or tobacco offcuts, wherein the plant leaf material is preferably bound into the decorative layer by a polysaccharide. In a preferred embodiment of the invention the polysaccharide is dissolved or suspended in a solvent or dispersant, which contains or consists of a polyvalent alcohol such as glycerol, before the formation of the decorative layer.

In another preferred embodiment, plant leaves and/or segments and/or panicles are the plant leaf material of the decorative layer. Such a decorative layer gives the layer composite a particularly natural and superior visual appearance and can therefore also be called finishing layer. Similarly to the case with animal leathers such as crocodile leather or snakeskin, such a decorative layer gives the layer composite a unique, consistently differently structured and vibrant visual appearance. In order to achieve particularly good visual and haptic properties of the composite, in a preferred embodiment of the invention the leaves are laid overlapping. This results in a decorative layer with sections with different thicknesses. These "irregularities" of the layer composite give the user the impression of a particularly natural imitation leather.

In a further preferred embodiment, the plant leaf material of the decorative layer is reconstituted tobacco. According to the invention, by reconstituted tobacco is meant a film in which pressed tobacco waste, tobacco powder, ground tobacco leaves and/or stalks have been combined with a binder, usually cellulose and polysaccharide derivatives, or deposited on carrier materials made of fibrous cellulose coated with setting agents and processed to form a flat, continuous band of almost uniform thickness and quality. The treatment of the reconstituted tobacco with a mixture of water and a polyvalent alcohol, in particular glycerol, has proved to be particularly advantageous.

Reconstituted tobacco has the advantage of particularly good availability at low purchase prices. In addition, a particularly homogeneous decorative layer can be produced using reconstituted tobacco. This can be advantageous in some applications of the layer composite, for example when a particularly uniform colouring is desired.

In a preferred embodiment, the thickness of the decorative layer is 0.1 to 10 mm, more preferably 0.1 to 5 mm, particularly preferably 0.1 to 2 mm, most preferably 0.2 to 1 mm.

In a preferred embodiment, the mass per unit area (grammage) of the decorative layer is 40 to 150 $g/m^2$, more preferably 65 to 120 $g/m^2$, particularly preferably 70 to 100 $g/m^2$, most preferably 80 to 100 $m^2$. Particularly light layer composites can be produced through a low mass per unit area.

The cover layer of the layer composite contains or consists of a plastic, wax or protein material or a mixture of the above-named. It serves substantially to protect the decorative layer arranged below it from external influences such as moisture, abrasion and/or radiation.

In the case of high standards for strength, water resistance and abrasion resistance, plastic materials are preferred. According to the invention, this includes all cloths which consist of macromolecules of natural or synthetic origin.

In a preferred embodiment, the plastic contains a material, or consists of this material, which is selected from the group consisting of polypropylene (PP), polyethylene (PE), polyvinyl butyral (PVB), polyamide (PA), polyester, in particular polybutylene terephthalate (PBT) and polyethylene terephthalate (PET), polyurethane (PU), polyethylene oxides, polyphenylene oxides, thermoplastic polyurethanes (TPU), polyurea, polyacetal, polyacrylate, poly(meth)acrylates, polyoxymethylene (POM), polyvinyl acetal, polystyrene (PS), acrylic butadiene styrene (ABS), acrylonitrile styrene acrylate (ASA), polysaccharides, in particular pectin and agar-agar, polycarbonates, polyethersulfones, polysulfonates, polytetrafluoroethylene (PTFE), polyurea, formaldehyde resins, melamine resins, polyetherketone, polyvinyl chloride, polylactide, polysiloxane, phenolic resins, epoxy resins, poly(imide), bismaleimide-triazine, thermoplastic polyurethane, ethylene-vinyl acetate (EVA), polylactide (PLA), polyhydroxybutyrate (PHB), copolymers and/or mixtures of the above-named polymers. PE, PET, PU and PA are particularly preferred.

The plastic is preferably used in the form of a film. According to the invention, by this is meant a flat plastic material produced in webs with a layer thickness<5 mm, preferably <1 mm.

In the case of high standards for feel, smell and appearance, a decorative layer made of protein material or wax is preferred.

By wax is meant according to the invention natural or artificially created substances which are kneadable at 20 C, solid to brittle-hard, have a coarse to finely crystalline structure, are coloured translucent to opaque but not glassy, melt above 40° C. without decomposing, are slightly liquid, i.e. are a little viscous, just above the melting point, have a strongly temperature-dependent consistency and solubility and can be polished with light pressure. This corresponds to the definition according to the Rompp Chemie Lexikon, $10^{th}$ Edition, 1999 Georg Thieme Verlag.

In the case of waxes, it is possible to distinguish between natural waxes, chemically modified waxes and synthetic waxes. In a preferred embodiment of the invention, the wax material is selected from the group of the natural waxes, particularly preferably from the group of the vegetable waxes, in particular candelilla wax, carnauba wax, Japan wax, esparto wax, cork wax, guaruma wax, rice bran wax, sugarcane wax, ouricury wax, montan wax.

In another preferred embodiment the natural wax is selected from the group consisting of animal waxes and mineral waxes, in particular from the group consisting of beeswax, shellac wax, spermaceti, lanolin (wool wax), uropygial fat, ceresin, ozokerite (earthwax).

Natural waxes provide the advantage that they are not based on petroleum and thus contribute to the sustainability and biodegradability of the layer composite.

In another embodiment the wax is selected from the group consisting of chemically modified waxes or synthetic waxes, in particular from the group selected from montan ester waxes, Sasol waxes, paraffins, hydrogenated jojoba waxes, polyalkylene waxes, polyethylene glycol waxes.

In a further preferred embodiment, the cover layer of the layer composite contains or consists of a protein material. These proteins are preferably of plant origin. Proteins which are contained in lupins, soya, peas, flax seeds, wheat, maize and/or rapeseed are particularly preferred here.

In a further embodiment the proteins are of animal origin, wherein gelatin, casein, whey proteins and/or derivatives thereof are particularly preferred.

The advantage of a protein cover layer is that the costs for producing the protein layer are very low and that it is non-hazardous to health. The layer can also be processed without organic solvents, i.e. water-based. It is further to be emphasized that the protein cover layer consists of renewable raw materials, which are biodegradable as well as self-adhesive or adhesive.

In a preferred embodiment, the thickness of the cover layer is 5 μm-1 mm, more preferably 10 μm to 0.5 mm, particularly preferably 20 μm to 0.1 mm, most preferably 50 μm to 0.1 mm.

The cover layer can furthermore contain additives, such as dyes, UV filters, binders or fillers. Through the addition of additives and fillers, the properties of the cover layer can be altered, in particular colour, strength and production cost.

The additives are preferably selected from the group consisting of calcium carbonate, chemical and physical UV filters such as titanium dioxide, calcium and barium sulfate, aluminium hydroxide, silicates, such as talc, clay or mica, kaolin or wollastonite, glass fibres, dyes, silica, glass fibres and glass beads as well as cellulose powder, carbon blacks and graphites.

In a preferred embodiment, the layer composite has the following layers:

a) a carrier layer, which consists of textile material,
b) a decorative layer, which consists of plant leaf material,
c) a cover layer, which consists of a plastic, wax or protein material or a mixture of the above-named, wherein the decorative layer is arranged between the textile carrier layer and the cover layer.

In a further preferred embodiment, the layer composite has the following layers:

a) a cover layer, which consists of textile material,
b) a decorative layer, which consists of plant leaf material,
c) a cover layer, which contains a plastic, wax or protein material or a mixture of the above-named.

In a further preferred embodiment, the layer composite has the following layers:

a) a carrier layer, which consists of textile material,
b) a decorative layer, which contains plant leaf material,
c) a cover layer, which contains a plastic, wax or protein material or a mixture of the above-named, wherein the decorative layer is arranged between the textile carrier layer and the cover layer.

In another preferred embodiment, the layer composite consists of the following layers:

a) a carrier layer, which consists of textile material,
b) a decorative layer, which consists of plant leaf material,
c) a cover layer, which consists of a plastic, wax or protein material or a mixture of the above-named, wherein the decorative layer is arranged between the textile carrier layer and the cover layer.

In another preferred embodiment, the layer composite has the following layers:

a) a carrier layer, which consists of textile material,
b) a decorative layer, which consists of tobacco,
c) a cover layer, which consists of a plastic, wax or protein material or a mixture of the above-named, wherein the decorative layer is arranged between the textile carrier layer and the cover layer.

In a further preferred embodiment, the layer composite has the following layers:

a) a carrier layer, which consists of textile material,
b) a decorative layer, which consists of tobacco,
c) a cover layer, which contains a plastic, wax or protein material or a mixture of the above-named.

In a further preferred embodiment, the layer composite has the following layers:

a) a carrier layer, which consists of textile material,
b) a decorative layer, which contains tobacco,
c) a cover layer, which contains a plastic, wax or protein material or a mixture of the above-named, wherein the decorative layer is arranged between the textile carrier layer and the cover layer.

In another preferred embodiment, the layer composite consists of the following layers:

a) a carrier layer, which consists of textile material,
b) a decorative layer, which consists of tobacco,
c) a cover layer, which consists of a plastic, wax or protein material or a mixture of the above-named, wherein the decorative layer is arranged between the textile carrier layer and the cover layer.

In a particularly preferred embodiment, the layer composite consists of a carrier layer made of a flax nonwoven fabric or a woven fabric, a decorative layer made of the plant material tobacco and a cover layer made of a plastic, wax or protein material, preferably of polyethylene, polyethylene terephthalate, polyurethane, polyamide or a mixture of the above-named plastics.

The layer composite can have yet further layers. These are preferably selected from the group consisting of carrier, decorative, adhesive and cover layers. The layer composite particularly preferably has one or more additional decorative layers, which are arranged between carrier layer and cover layer. In a preferred embodiment, the additional layers are arranged on both sides of the carrier layer. In this connection, the symmetrical arrangement of the layers in relation to the carrier layer is particularly preferably, for example, a layer sequence: $1^{st}$ cover layer, $1^{st}$ decorative layer, carrier layer, $2^{nd}$ decorative layer, $2^{nd}$ cover layer.

In a preferred embodiment of the invention, the layer composite only has adhesive layers as further layers. In another preferred embodiment, the layer composite has no further layers besides carrier, decorative and cover layers.

In a preferred embodiment, the individual thicknesses of these additional layers are 0.1 to 10 mm, more preferably 0.5 to 8 mm, particularly preferably 1 to 5 mm, most preferably 2 to 4 mm.

In a preferred embodiment, the mass per unit area (grammage) of the additional layers is 50 to 200 g/m$^2$, more preferably 65 to 130 g/m$^2$, particularly preferably 80 to 120 g/m$^2$, most preferably 90 to 110 m$^2$. Particularly light layer composites can be produced through a low mass per unit area.

In a preferred embodiment, the layer composite can have one or more adhesive layers. The adhesive of the adhesive layers can be chemically curing and/or physically setting.

The adhesive of the adhesive layers is preferably selected from the group consisting of cyanoacrylates, methyl methacrylates, unsaturated polyesters, dispersion adhesives, wet adhesives containing solvent or dispersant, protein-based adhesives, hot-melt adhesives, plastisols, epoxy adhesives, polyurethane adhesives, silicones, resins, in particular phenolic resins, polyimides, polysulfides, poly(meth)acrylates, polyvinyl acetates, rubbers and bismaleimides.

In order to produce the material in an extremely environmentally friendly manner, protein adhesives are particularly preferred.

The curing of the adhesive is preferably effected by chemical hardening or solidification by cooling. As a result, small quantities of solvent or dispersant can be used or solvent and dispersant can even be dispensed with entirely. This is not only particularly sustainable, as a rule the processing times and the bonding within the layer composite are also better.

In a further advantageous embodiment, the strength, in particular the tensile strength and/or the bending tensile strength, of one, several or all cover and/or carrier layers is greater than that of the at least one decorative layer.

The tensile strength, also tear strength, is the maximum tensile stress which a body withstands. It can be determined by a tensile test.

The bending tensile strength denotes the maximum tensile stress that a body can absorb in the case of loading by bending. It can be determined by means of a 3- or 4-point flexural test.

In an advantageous embodiment, when the strength, in particular the tensile strength and/or bending tensile strength, of one, several or all cover and/or carrier layers is greater than that of the at least one decorative layer, the carrier and/or cover layers can absorb the stresses forming in the case of mechanical loading, with the result that the at least one decorative layer does not break, or only breaks under a higher load, whereby disadvantageous cracks in the layer determining the visual appearance would form.

The elasticity of the decorative layer, and thus its strength, can be increased by fermentation and/or chemical treatment of the plant material. The treatment of fermented leaves with a mixture of water and a polyvalent alcohol, in particular glycerol, has proved to be particularly advantageous.

Tobacco leaves are suitable in particular because they have inherently good moisture-regulating properties and do not tend to break.

The invention also comprises a method for producing the layer composite, which has the following steps:

A) applying a plant leaf material to a carrier layer or a cover layer, with the result that a decorative layer is formed, which preferably covers 90% of a flat side of the carrier layer or the cover layer, B) applying a cover layer made of a plastic, wax or protein material or a mixture of the above-named to the decorative layer, if the decorative layer was applied to a carrier layer in step A), or applying a carrier layer, if the decorative layer was applied to a cover layer in step A).

According to the invention, by applying is meant producing a firm connection between the layers. This can be effected, for example, by gluing, curing a layer, needle-punching or 3D printing.

In a preferred embodiment of the invention, a transfer film is used in the production method.

In a preferred embodiment of the invention, in step A) the plant leaf material is applied to a carrier layer and in step B) the cover layer is applied to the decorative layer.

In another preferred embodiment of the invention, in step A) the plant leaf material is applied to a cover layer and in step B) the carrier layer is applied to the decorative layer.

In a preferred embodiment, an already cured layer, such as for example a plastic film, can be applied to the decorative layer. This can take place, for example, in that the adhesive is applied to the decorative layer and/or the plastic film, the film is placed on the decorative layer and the layers are preferably pressed together under pressure. Alternatively and/or additionally, the cover layer can be needle-punched with the decorative layer.

In a particularly preferred embodiment of the method, a polyethylene layer is glued to the decorative layer in a laminating system for paper products.

In another embodiment of the invention, a composition yet to be cured, which forms the cover layer, can be deposited on the decorative layer. For example, one or more waxes, which cure on the decorative layer, can be deposited on the decorative layer.

The hardening of the composition and the formation of the cover layer can also be effected under the influence of increased temperatures, pressure and/or radiation.

In another embodiment of the invention, the layers are additionally needle-punched. Needle-punching the layers has the advantage that the permeability, for example for gases such as water vapour, can be significantly increased.

As the carrier layer is supplied as a continuous web as a rule, the production of the layer composite can be effected in a continuous process, which represents a considerable advantage over the discontinuous method of animal leather production.

The cover layers for screen printing usual in the textiles sector have also been tested successfully. Cover layers which are produced from water-based mixed systems for textile printing are particularly preferred in this connection. These water-based mixed systems have a water-based binder, in particular a synthetic resin dispersion binder, which preferably has a transparency≥80% and/or contains further constituents such as pigments, adhesion promoters or fillers. Water-based mixed systems which are free of organic solvents or dispersants, phthalates, formaldehyde, alkylphenols and alkylphenol ethoxylates are particularly preferred. The water-based mixed systems are preferably free of ingredients requiring labelling, non-toxic and skin-friendly.

After being deposited on the decorative layer, the water-based mixed systems are preferably dried with the supply of heat, and then heat-set at a temperature of 150-160° C. The setting can be effected with a transfer press, a drying tunnel, a heat gun, an iron, an ironing press or in an oven. At the temperatures named above the setting time is 2-3 minutes.

In a particularly preferred embodiment, the production method is carried out as described below. First of all, the carrier layer is transported by rollers. The adhesive is deposited in a first area. The plant leaves coated with adhesive are placed on in a following area. The plant leaves are pressed on by a heated calender or pressing roller in an area following this. The cover layer is deposited in a further area. If the cover layer is a plastic material in the form of a film, it can be glued on using a heated calender.

In a preferred embodiment of the invention, the method has the following additional method steps:

C) dispersing the plant leaf material in an aqueous solvent or dispersant before it is applied to the carrier layer or cover layer, wherein the plant material is preferably tobacco, D) removing the aqueous solvent or dispersant from the dispersion after the dispersion has been applied to the carrier layer or cover layer, preferably at increased temperature and/or decreased pressure, with the result that the decorative layer is formed.

Optionally:

E) needle-punching and/or gluing together at least two layers of the layer composite.

In a preferred embodiment, steps A) to E) are carried out in the order A), B), C), D), E).

In a preferred embodiment of the method, adhesive is applied to the plant leaf material and/or the carrier layer before the plant leaf material is applied to the textile carrier layer. A particularly firm bond can hereby be achieved between carrier layer and decorative layer.

In a preferred embodiment of the method, the layers of the composite are pressed together under increased pressure, wherein the pressing together is effected in a transfer press and/or using increased temperatures.

In a preferred embodiment of the method, the aqueous solvent or dispersant contains a binder selected from the group consisting of polysaccharides, in particular agar-agar, pectin, xanthan gum, natural and synthetic resins, gelatin, alginate, chitosan, cellulose ether, modified starch, mucilage or mixtures of the above-named.

During the production method, the binder serves to achieve a higher viscosity of the dispersion. As a result, it can be applied to the carrier layer better. After the production method, the binder, which remains in the decorative layer, ensures a better bonding between the plant leaf material. This effect is particularly pronounced if the solvent or dispersant is a mixture of water and a polyvalent alcohol, in particular glycerol.

In a preferred embodiment of the method, the aqueous solvent or dispersant therefore contains an alcohol, preferably a polyvalent alcohol such as glycerol, glycol, polyethylene glycol or polyethylene oxide.

The invention furthermore comprises various uses of the layer composite according to the invention.

The layer composite is stable, lighter than animal leather, scratch-resistant, as well as water-repellent. It can therefore preferably be used as material for clothing and fashion accessories. According to the invention, clothing denotes the totality of all materials which fit around the human body more or less closely as an artificial covering. This also includes head coverings, in particular hats, and shoes. By fashion accessories is meant according to the invention accessories for clothing. These are preferably belts, gloves, fans, parasols or umbrellas, bags, scarves and jewellery, in particular watch straps.

The layer composite can also be used for linings and for upholstery.

In a preferred embodiment, the cover layer of the layer composite has a transmittance in the visible wavelength range of ≥30%, preferably ≥50%, more preferably ≥70% and most preferably of ≥90%. This makes it possible for the optical properties of the tobacco to stand out particularly well.

In a further preferred embodiment, the transmittance of both the textile carrier layer and the cover layer in the visible wavelength range is ≥30%, preferably ≥50%, more preferably ≥60% and most preferably of ≥80%. As a result, a layer composite can be obtained which can be backlit particularly well and can thus be used in various applications in the lighting sector, for example as a lampshade or in the interior of a motor vehicle.

EXAMPLES

The invention is now further explained with reference to specific embodiments of layer composites according to the invention, a production example as well as with reference to the attached figures.

In the following embodiments, the layer composite has layers with the materials listed in the respective cells. The layers contain or consist of the material named in the respective cells.

1. Embodiments with Different Carrier Layers

| # | Carrier layer | Decorative layer | Cover layer |
|---|---|---|---|
| T1 | Nonwoven fabric | Tobacco | PE/PP/PET/PU/PA |
| T2 | Nonwoven fabric | Tobacco | Wax |
| T3 | Nonwoven fabric | Tobacco | Protein material |
| T4 | Flax nonwoven fabric | Tobacco | PE/PP/PET/PU/PA |
| T5 | Flax nonwoven fabric | Tobacco | Wax |
| T6 | Flax nonwoven fabric | Tobacco | Protein material |

| # | Carrier layer | Decorative layer | Cover layer |
|---|---|---|---|
| T7 | Woven fabric | Tobacco | PE/PP/PET/PU/PA |
| T8 | Woven fabric | Tobacco | Wax |
| T9 | Woven fabric | Tobacco | Protein material |

| # | Carrier layer | Decorative layer | Cover layer |
|---|---|---|---|
| T10 | Natural fibre woven fabric | Tobacco | PE/PP/PET/PU/PA |
| T11 | Natural fibre woven fabric | Tobacco | Wax |
| T12 | Natural fibre woven fabric | Tobacco | Protein material |

| # | Carrier layer | Decorative layer | Cover layer |
|---|---|---|---|
| T13 | Man-made fibre woven fabric | Tobacco | PE/PP/PET/PU/PA |
| T14 | Man-made fibre woven fabric | Tobacco | Wax |
| T15 | Man-made fibre woven fabric | Tobacco | Protein material |

| # | Carrier layer | Decorative layer | Cover layer |
|---|---|---|---|
| T16 | Knitted fabric | Tobacco | PE/PP/PET/PU/PA |
| T17 | Knitted fabric | Tobacco | Wax |
| T18 | Knitted fabric | Tobacco | Protein material |

2. Embodiments with Different Decorative Layers

| # | Carrier layer | Decorative layer | Cover layer |
|---|---|---|---|
| D1 | Flax nonwoven fabric | Rose leaves | PE/PP/PET/PU/PA |
| D2 | Woven fabric | Rose leaves | PE/PP/PET/PU/PA |
| D3 | Knitted fabric | Rose leaves | PE/PP/PET/PU/PA |
| D4 | Flax nonwoven fabric | Vine leaves | PE/PP/PET/PU/PA |
| D5 | Woven fabric | Vine leaves | PE/PP/PET/PU/PA |
| D6 | Knitted fabric | Vine leaves | PE/PP/PET/PU/PA |
| D7 | Flax nonwoven fabric | Rose leaves | Wax |
| D8 | Woven fabric | Rose leaves | Wax |
| D9 | Knitted fabric | Rose leaves | Wax |
| D10 | Flax nonwoven fabric | Vine leaves | Wax |
| D11 | Woven fabric | Vine leaves | Wax |
| D12 | Knitted fabric | Vine leaves | Wax |
| D13 | Flax nonwoven fabric | Rose leaves | Protein material |
| D14 | Woven fabric | Rose leaves | Protein material |
| D15 | Knitted fabric | Rose leaves | Protein material |
| D16 | Flax nonwoven fabric | Vine leaves | Protein material |
| D17 | Woven fabric | Vine leaves | Protein material |
| D18 | Knitted fabric | Vine leaves | Protein material |

3. Embodiments with Different Cover Layers

| # | Carrier layer | Decorative layer | Cover layer |
|---|---|---|---|
| P1 | Flax nonwoven | Tobacco | PE |

-continued

| # | Carrier layer | Decorative layer | Cover layer |
|---|---|---|---|
| | fabric | | |
| P2 | Woven fabric | Tobacco | PE |
| P3 | Knitted fabric | Tobacco | PE |
| P4 | Flax nonwoven fabric | Tobacco | PP |
| P5 | Woven fabric | Tobacco | PP |
| P6 | Knitted fabric | Tobacco | PP |
| P7 | Flax nonwoven fabric | Tobacco | PET |
| P8 | Woven fabric | Tobacco | PET |
| P9 | Knitted fabric | Tobacco | PET |
| P10 | Flax nonwoven fabric | Tobacco | PU |
| P11 | Woven fabric | Tobacco | PU |
| P12 | Knitted fabric | Tobacco | PU |
| P13 | Flax nonwoven fabric | Tobacco | PA |
| P14 | Woven fabric | Tobacco | PA |
| P15 | Knitted fabric | Tobacco | PA |

4. Embodiments with Additional Layers

| # | Carrier layer | 1st Decorative layer | Additional layer | Cover layer |
|---|---|---|---|---|
| F1 | Flax nonwoven fabric | Tobacco | Carrier layer | PE/PP/PET/PU/PA |
| F2 | Woven fabric | Tobacco | Carrier layer | PE/PP/PET/PU/PA |
| F3 | Knitted fabric | Tobacco | Carrier layer | PE/PP/PET/PU/PA |
| F4 | Flax nonwoven fabric | Rose leaves | Carrier layer | PE/PP/PET/PU/PA |
| F5 | Woven fabric | Rose leaves | Carrier layer | PE/PP/PET/PU/PA |
| F6 | Knitted fabric | Rose leaves | Carrier layer | PE/PP/PET/PU/PA |
| F7 | Flax nonwoven fabric | Tobacco | Carrier layer | Wax |
| F8 | Woven fabric | Tobacco | Carrier layer | Wax |
| F10 | Knitted fabric | Tobacco | Carrier layer | Wax |
| F11 | Flax nonwoven fabric | Rose leaves | Carrier layer | Wax |
| F12 | Woven fabric | Rose leaves | Carrier layer | Wax |
| F13 | Knitted fabric | Rose leaves | Carrier layer | Wax |
| F14 | Flax nonwoven fabric | Tobacco | Carrier layer | Protein material |
| F15 | Woven fabric | Tobacco | Carrier layer | Protein material |
| F16 | Knitted fabric | Tobacco | Carrier layer | Protein material |
| F17 | Flax nonwoven fabric | Rose leaves | Carrier layer | Protein material |
| F18 | Woven fabric | Rose leaves | Carrier layer | Protein material |
| F19 | Knitted fabric | Rose leaves | Carrier layer | Protein material |

| # | Carrier layer | 1st Decorative layer | Additional layer | Cover layer |
|---|---|---|---|---|
| F20 | Flax nonwoven fabric | Tobacco | Decorative layer | PE/PP/PET/PU/PA |
| F21 | Woven fabric | Tobacco | Decorative layer | PE/PP/PET/PU/PA |
| F22 | Knitted fabric | Tobacco | Decorative layer | PE/PP/PET/PU/PA |
| F23 | Flax nonwoven fabric | Rose leaves | Decorative layer | PE/PP/PET/PU/PA |
| F24 | Woven fabric | Rose leaves | Decorative layer | PE/PP/PET/PU/PA |
| F25 | Knitted fabric | Rose leaves | Decorative layer | PE/PP/PET/PU/PA |
| F26 | Flax nonwoven fabric | Tobacco | Decorative layer | Wax |
| F27 | Woven fabric | Tobacco | Decorative layer | Wax |
| F28 | Knitted fabric | Tobacco | Decorative layer | Wax |
| F29 | Flax nonwoven fabric | Rose leaves | Decorative layer | Wax |
| F30 | Woven fabric | Rose leaves | Decorative layer | Wax |

-continued

| # | Carrier layer | 1st Decorative layer | Additional layer | Cover layer |
|---|---|---|---|---|
| F31 | Knitted fabric | Rose leaves | Decorative layer | Wax |
| F32 | Flax nonwoven fabric | Tobacco | Decorative layer | Protein material |
| F33 | Woven fabric | Tobacco | Decorative layer | Protein material |
| F34 | Knitted fabric | Tobacco | Decorative layer | Protein material |
| F35 | Flax nonwoven fabric | Rose leaves | Decorative layer | Protein material |
| F36 | Woven fabric | Rose leaves | Decorative layer | Protein material |
| F37 | Knitted fabric | Rose leaves | Decorative layer | Protein material |

| # | Carrier layer | 1st Decorative layer | Additional layer | Cover layer |
|---|---|---|---|---|
| F38 | Flax nonwoven fabric | Tobacco | Cover layer | PE/PP/PET/PU/PA |
| F39 | Woven fabric | Tobacco | Cover layer | PE/PP/PET/PU/PA |
| F40 | Knitted fabric | Tobacco | Cover layer | PE/PP/PET/PU/PA |
| F41 | Flax nonwoven fabric | Rose leaves | Cover layer | PE/PP/PET/PU/PA |
| F42 | Woven fabric | Rose leaves | Cover layer | PE/PP/PET/PU/PA |
| F43 | Knitted fabric | Rose leaves | Cover layer | PE/PP/PET/PU/PA |
| F44 | Flax nonwoven fabric | Tobacco | Cover layer | Wax |
| F45 | Woven fabric | Tobacco | Cover layer | Wax |
| F46 | Knitted fabric | Tobacco | Cover layer | Wax |
| F47 | Flax nonwoven fabric | Rose leaves | Cover layer | Wax |
| F48 | Woven fabric | Rose leaves | Cover layer | Wax |
| F49 | Knitted fabric | Rose leaves | Cover layer | Wax |
| F50 | Flax nonwoven fabric | Tobacco | Cover layer | Protein material |
| F51 | Woven fabric | Tobacco | Cover layer | Protein material |
| F52 | Knitted fabric | Tobacco | Cover layer | Protein material |
| F53 | Flax nonwoven fabric | Rose leaves | Cover layer | Protein material |
| F54 | Woven fabric | Rose leaves | Cover layer | Protein material |
| F55 | Knitted fabric | Rose leaves | Cover layer | Protein material |

5. Embodiments with Further Decorative Layer Made of Reconstituted Tobacco

| # | Carrier layer | 1st Decorative layer | 2nd Decorative layer | Cover layer |
|---|---|---|---|---|
| S1 | Flax nonwoven fabric | Tobacco | Reconstituted tobacco | PE/PP/PET/PU/PA |
| S2 | Woven fabric | Tobacco | Reconstituted tobacco | PE/PP/PET/PU/PA |
| S3 | Knitted fabric | Tobacco | Reconstituted tobacco | PE/PP/PET/PU/PA |
| S4 | Flax nonwoven fabric | Rose leaves | Reconstituted tobacco | PE/PP/PET/PU/PA |
| S5 | Woven fabric | Rose leaves | Reconstituted tobacco | PE/PP/PET/PU/PA |
| S6 | Knitted fabric | Rose leaves | Reconstituted tobacco | PE/PP/PET/PU/PA |
| S7 | Flax nonwoven fabric | Tobacco | Reconstituted tobacco | Wax |
| S8 | Woven fabric | Tobacco | Reconstituted tobacco | Wax |
| S9 | Knitted fabric | Tobacco | Reconstituted tobacco | Wax |
| S10 | Flax nonwoven fabric | Rose leaves | Reconstituted tobacco | Wax |
| S11 | Woven fabric | Rose leaves | Reconstituted tobacco | Wax |
| S12 | Knitted fabric | Rose leaves | Reconstituted | Wax |

-continued

| # | Carrier layer | 1st Decorative layer | 2nd Decorative layer | Cover layer |
|---|---|---|---|---|
| | | | tobacco | |
| S13 | Flax nonwoven fabric | Tobacco | Reconstituted tobacco | Protein material |
| S14 | Woven fabric | Tobacco | Reconstituted tobacco | Protein material |
| S15 | Knitted fabric | Tobacco | Reconstituted tobacco | Protein material |
| S16 | Flax nonwoven fabric | Rose leaves | Reconstituted tobacco | Protein material |
| S17 | Woven fabric | Rose leaves | Reconstituted tobacco | Protein material |
| S18 | Knitted fabric | Rose leaves | Reconstituted tobacco | Protein material |

6. Embodiments with Further Layers on Both Sides of the Carrier Layer (Unsymmetrical)

| # | 1st Cover layer | 1st Decorative layer | Carrier layer | 2nd Decorative layer | 2nd Cover layer |
|---|---|---|---|---|---|
| Q1 | PE/PP/PET/PU/PA | Reconstituted tobacco | Flax nonwoven fabric | Tobacco | PE/PP/PET/PU/PA |
| Q2 | PE/PP/PET/PU/PA | Reconstituted tobacco | Woven fabric | Tobacco | PE/PP/PET/PU/PA |
| Q3 | PE/PP/PET/PU/PA | Reconstituted tobacco | Knitted fabric | Tobacco | PE/PP/PET/PU/PA |
| Q4 | PE/PP/PET/PU/PA | Reconstituted tobacco | Flax nonwoven fabric | Rose leaves | PE/PP/PET/PUPA |
| Q5 | PE/PP/PET/PU/PA | Reconstituted tobacco | Woven fabric | Rose leaves | PE/PP/PET/PU/PA |
| Q6 | PE/PP/PET/PU/PA | Reconstituted tobacco | Knitted fabric | Rose leaves | PE/PP/PET/PU/PA |
| Q7 | Wax | Reconstituted tobacco | Flax nonwoven fabric | Tobacco | Wax |
| Q8 | Wax | Reconstituted tobacco | Woven fabric | Tobacco | Wax |
| Q9 | Wax | Reconstituted tobacco | Knitted fabric | Tobacco | Wax |
| Q10 | Wax | Reconstituted tobacco | Flax nonwoven fabric | Rose leaves | Wax |
| Q11 | Wax | Reconstituted tobacco | Woven fabric | Rose leaves | Wax |
| Q12 | Wax | Reconstituted tobacco | Knitted fabric | Rose leaves | Wax |
| Q13 | Protein material | Reconstituted tobacco | Flax nonwoven fabric | Tobacco | Protein material |
| Q14 | Protein material | Reconstituted tobacco | Woven fabric | Tobacco | Protein material |
| Q15 | Protein material | Reconstituted tobacco | Knitted fabric | Tobacco | Protein material |
| Q16 | Protein material | Reconstituted tobacco | Flax nonwoven fabric | Rose leaves | Protein material |
| Q17 | Protein material | Reconstituted tobacco | Woven fabric | Rose leaves | Protein material |
| Q18 | Protein material | Reconstituted tobacco | Knitted fabric | Rose leaves | Protein material |

7. Embodiments with Further Layers on Both Sides of the Carrier Layer (Symmetrical)

| # | 1st Cover layer | 1st Decorative layer | Carrier layer | 2nd Decorative layer | 2nd Cover layer |
|---|---|---|---|---|---|
| M1 | PE/PP/PET/PU/PA | Tobacco | Flax nonwoven fabric | Tobacco | PE/PP/PET/PU/PA |
| M2 | PE/PP/PET/PU/PA | Tobacco | Woven fabric | Tobacco | PE/PP/PET/PU/PA |
| M3 | PE/PP/PET/PU/PA | Tobacco | Knitted fabric | Tobacco | PE/PP/PET/PU/PA |
| M4 | PE/PP/PET/PU/PA | Rose leaves | Flax nonwoven fabric | Rose leaves | PE/PP/PET/PU/PA |
| M5 | PE/PP/PET/PU/PA | Rose leaves | Woven fabric | Rose leaves | PE/PP/PET/PU/PA |
| M6 | PE/PP/PET/PU/PA | Rose leaves | Knitted fabric | Rose leaves | PE/PP/PET/PU/PA |
| M7 | Wax | Tobacco | Flax nonwoven fabric | Tobacco | Wax |
| M8 | Wax | Tobacco | Woven fabric | Tobacco | Wax |
| M9 | Wax | Tobacco | Knitted fabric | Tobacco | Wax |
| M10 | Wax | Rose leaves | Flax nonwoven fabric | Rose leaves | Wax |
| M11 | Wax | Rose leaves | Woven fabric | Rose leaves | Wax |
| M12 | Wax | Rose leaves | Knitted fabric | Rose leaves | Wax |
| M13 | Protein material | Tobacco | Flax nonwoven fabric | Tobacco | Protein material |
| M14 | Protein material | Tobacco | Woven fabric | Tobacco | Protein material |
| M15 | Protein material | Tobacco | Knitted fabric | Tobacco | Protein material |
| M16 | Protein material | Rose leaves | Flax nonwoven fabric | Rose leaves | Protein material |
| M17 | Protein material | Rose leaves | Woven fabric | Rose leaves | Protein material |
| M18 | Protein material | Rose leaves | Knitted fabric | Rose leaves | Protein material |

Production Example 50 g rose leaves are dispersed in 50 ml of a glycerol/water solution and, after the solvent or dispersant has been decanted, deposited on an area of surface of a flax nonwoven fabric with a grammage of 100 g/m$^2$. The aqueous solvent or dispersant is removed by air drying at 50° C., in order to obtain a uniform decorative layer. A liquid beeswax heated to 60° C. is deposited on this and allowed to cool, in order to produce a uniform cover layer.

LIST OF REFERENCE NUMBERS

1 Carrier layer
2 Adhesive
3 Reconstituted tobacco
4 Adhesive substance layer
5 Tobacco
6 Adhesive layer
7 Cover layer

DETAILED DESCRIPTION OF THE FIGURES

Figure 1:
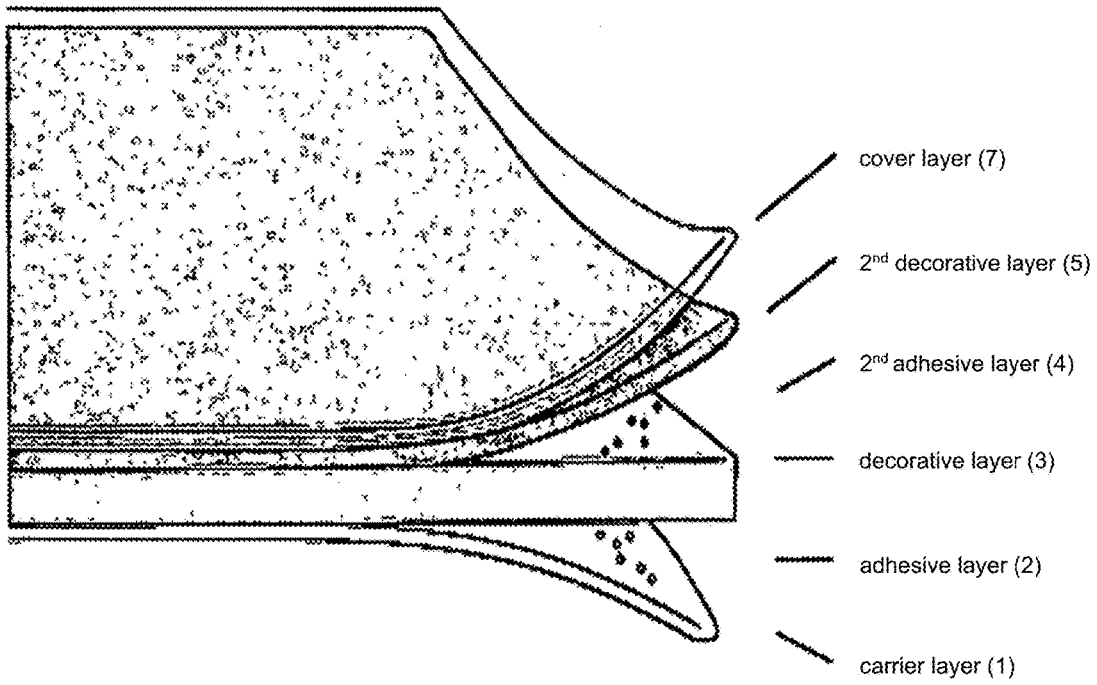
FIG. 1: schematic sectional representation of the layer composite with carrier, adhesive, decorative, 2nd adhesive, 2nd decorative and cover layers.

FIG. 1 shows the layer structure of a layer composite according to the invention which has carrier, adhesive, decorative, $2^{nd}$ adhesive, $2^{nd}$ decorative and cover layers. The carrier layer 1 is joined to the decorative layer made of reconstituted tobacco 3 by the adhesive 2. The $2^{nd}$ decorative layer 5 made of tobacco is joined to the decorative layer 3 and the cover layer 7 by the adhesive 4. The plant leaf material of the decorative layer 5 is joined together by adhesive.

Figure 2:
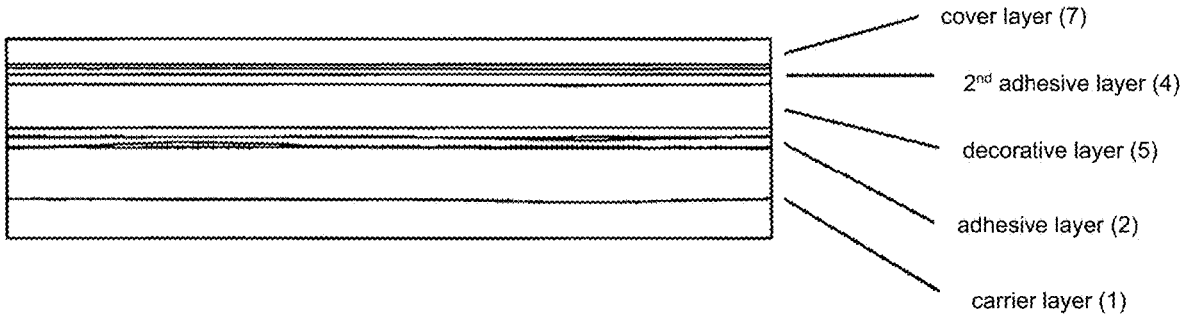
FIG. 2: schematic sectional representation of the layer composite with carrier, adhesive, decorative, 2nd adhesive and cover layers.

FIG. 2 shows the layer structure of a layer composite according to the invention which has a carrier layer, adhesive, decorative layer, $2^{nd}$ adhesive layer and cover layer. The carrier layer 1 is joined to the decorative layer 5 by the adhesive 2. The decorative layer 5 made of tobacco is joined to the decorative layer 3 and the cover layer 7 by the adhesive 4. The plant leaf material of the decorative layer 5 is joined together by adhesive.

Figure 3:
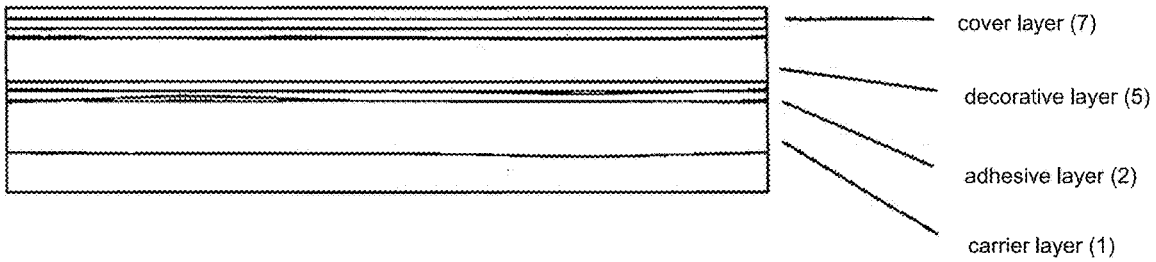
FIG. 3: schematic sectional representation of the layer composite with carrier, adhesive, decorative and cover layers.

FIG. 3 shows the layer structure of a layer composite according to the invention which has a carrier layer, adhesive layer, decorative layer and cover layer. The carrier layer 1 is joined to the decorative layer 5 by the adhesive 2. The decorative layer 5 made of tobacco is joined to the decorative layer 3 and the cover layer 7 by the adhesive 4. The plant leaf material of the decorative layer 5 is joined together by adhesive.

Figure 4:
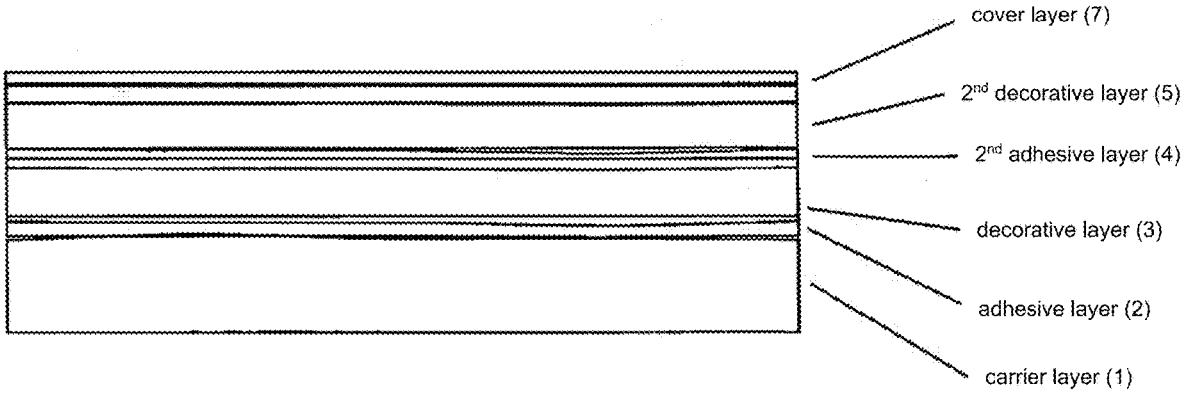
FIG. 4: schematic sectional representation of the layer composite with carrier, adhesive, decorative, 2nd adhesive, 2nd decorative and cover layers, FIGS. 5*a/b*: laying pattern of the tobacco leaves of an example decorative layer.

FIG. 4 shows the layer structure of a layer composite according to the invention, has carrier, adhesive, decorative, $2^{nd}$ adhesive, $2^{nd}$ decorative and cover layers. The carrier layer 1 is joined to the decorative layer made of reconstituted tobacco 3 by the adhesive 2. The $2^{nd}$ decorative layer 5 made of tobacco is joined to the decorative layer 3 and the cover layer 7 by the adhesive 4. The plant leaf material of the decorative layer 5 is joined together by adhesive.

Figure 5A:
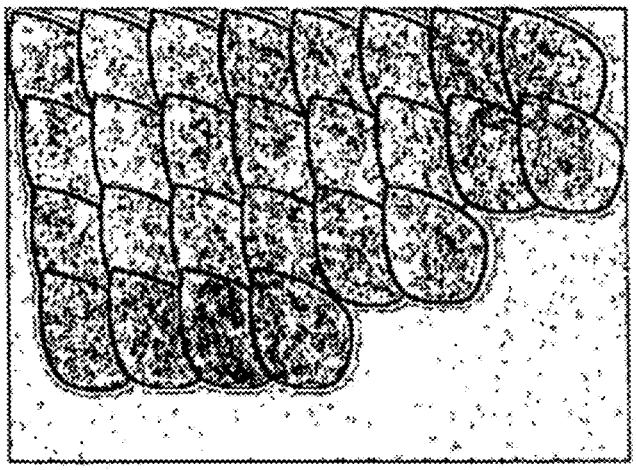
Figure 5B:
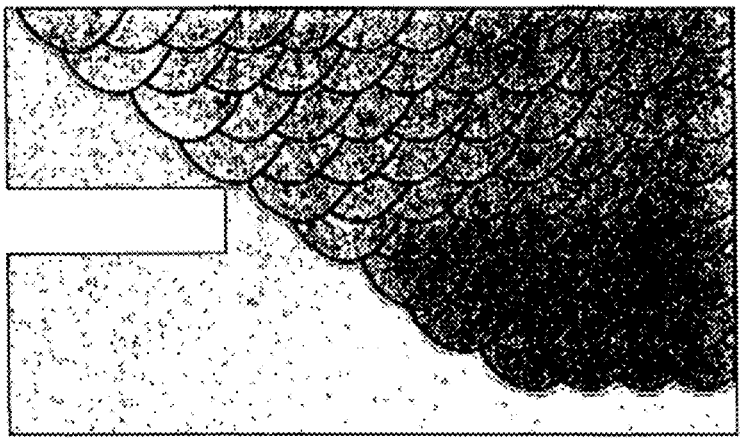

Possible laying patterns of the tobacco leaves are shown in FIGS. 5*a/b*. The laying pattern is to ensure that the carrier layer is ≥90%, particularly preferably completely, covered by leaf material on one of its flat sides.

The invention claimed is:

1. A layer composite for use as imitation leather, which has the following layers:

a) a carrier layer, which contains textile material,
b) a decorative layer, which contains or consists of plant leaf material,
c) a cover layer, which contains a plastic material,
wherein the decorative layer is arranged between the textile carrier layer and the cover layer.

2. The layer composite according to claim 1, wherein the carrier layer contains a nonwoven fabric, and/or a woven fabric.

3. The layer composite according to claim 1, wherein the plant leaf material of the decorative layer is finely ground tobacco and/or tobacco powder and/or tobacco offcuts.

4. The layer composite according to claim 3, wherein the decorative layer further contains a binder based on a polysaccharide.

5. The layer composite according to claim 1, wherein the plastic material, which is selected from the group consisting of polypropylene (PP), polyethylene (PE), polyvinyl butyral (PVB), polyamide (PA), polyester, polyurethane (PU), polyethylene oxides, polyphenylene oxides, thermoplastic polyurethanes (TPU), polyurea, polyacetal, polyacrylate, poly (meth)acrylates, polyoxymethylene (POM), polyvinyl acetal, polystyrene (PS), acrylic butadiene styrene (ABS), acrylonitrile styrene acrylate (ASA), polysaccharides, polyethersulfones, polysulfonates, polytetrafluoroethylene (PTFE), polyurea, formaldehyde resins, melamine resins, polyetherketone, polyvinyl chloride, polylactide, polysiloxane, phenolic resins, epoxy resins, poly(imide), bismaleimidetriazine, thermoplastic polyurethane, ethylene-vinyl acetate (EVA), polylactide (PLA), polyhydroxybutyrate (PHB), copolymers and/or mixtures of the above-named polymers.

6. The layer composite according to claim 1, wherein the layer composite consists of a carrier layer made of flax nonwoven fabric or a woven fabric, a decorative layer made of the plant material tobacco and a cover layer made of a plastic material.

7. The layer composite according to claim 1, wherein the layer composite has one or more additional decorative layers, which are arranged between the carrier layer and the cover layer.

8. The layer composite according to claim 1, wherein the layer composite has one or more adhesive layers.

9. The layer composite according to claim 1, wherein the tensile strength and/or the bending tensile strength of one, several or all cover and/or carrier layers is greater than that of the at least one decorative layer.

10. A method comprising incorporating the layer composite according to claim 1 in clothing or fashion accessories.

11. A method for producing the layer composite according to claim 1, which has the following steps:

A) applying a plant leaf material to a carrier layer or a cover layer, with the result that a decorative layer is formed,
B) applying a cover layer containing a plastic material to the decorative layer, if the decorative layer was applied to a carrier layer in step A), or applying a carrier layer, if the decorative layer was applied to a cover layer in step A).

12. The method according to claim 11, wherein the method has the following additional method steps:

C) dispersing the plant leaf material in an aqueous solvent or dispersant before it is applied to the carrier layer or cover layer,
D) removing the aqueous solvent or dispersant from the dispersion after the dispersion has been applied to the carrier layer or cover layer with the result that the decorative layer is formed,
optionally:
E) needle-punching and/or gluing together at least two layers of the layer composite.

13. The method according to claim 12, wherein the aqueous solvent or dispersant contains a binder selected from the group consisting of polysaccharides, in particular agar-agar, chitosan, pectin and xanthan gum, natural and synthetic resins, gelatin, alginate, cellulose ether, modified starch, mucilage or mixtures of the above-named.

14. The method according to claim 12, wherein the aqueous solvent or dispersant contains an alcohol.

15. The method according to claim 11, wherein adhesive is applied to the plant leaf material and/or the carrier layer before the plant leaf material is applied to the textile carrier layer.

16. The method according to claim 11, wherein the layers of the composite are pressed together, wherein the pressing together is effected in a transfer press and/or using increased temperatures.

17. A layer composite for use as imitation leather, which has the following layers:

a) a carrier layer, which contains textile material, b) a decorative layer, which contains or consists of plant leaf material, c) a cover layer, which contains wax or protein material, wherein the decorative layer is arranged between the textile carrier layer and the cover layer.

18. The layer composite according to claim 17, wherein the layer composite consists of a carrier layer made of flax nonwoven fabric or a woven fabric, a decorative layer made of the plant material tobacco and a cover layer made of wax or protein material.

19. A method for producing the layer composite according to claim 17, which has the following steps:

A) applying a plant leaf material to a carrier layer or a cover layer, with the result that a decorative layer is formed, B) applying a cover layer containing wax or protein material, if the decorative layer was applied to a carrier layer in step A), or applying a carrier layer, if the decorative layer was applied to a cover layer in step A).

20. The method according to claim 19, wherein, in the step of applying a plant leaf material to a carrier layer or a cover layer to form the decorative layer, the decorative layer covers ≥90% of a flat side of the carrier layer or the cover layer.

* * * * *